United States Patent [19]

Hala

[11] 4,009,549

[45] Mar. 1, 1977

[54] STONE STRUCTURAL SECUREMENT SYSTEM AND METHOD

[75] Inventor: Alfred A. Hala, Islip, N.Y.

[73] Assignee: Hohmann & Barnard, Inc., Hauppauge, N.Y.

[22] Filed: Nov. 25, 1975

[21] Appl. No.: 635,099

[52] U.S. Cl. ..... 52/506; 52/235; 52/477; 52/747

[51] Int. Cl.[2] ..... E04B 1/38

[58] Field of Search ..... 52/506–509, 52/474, 476, 477, 486, 235, 378, 489, 741, 747

[56] References Cited

UNITED STATES PATENTS

| | | | |
|---|---|---|---|
| 3,110,131 | 11/1963 | Jeffress | 52/235 |
| 3,465,996 | 9/1969 | Von Wedel | 52/235 |
| 3,572,000 | 3/1971 | Gustavsson | 52/508 |
| 3,640,043 | 2/1972 | Querfeld et al. | 52/508 |

FOREIGN PATENTS OR APPLICATIONS

| | | | |
|---|---|---|---|
| 1,472,528 | 1/1967 | France | 52/235 |
| 2,021,461 | 11/1971 | Germany | 52/235 |

*Primary Examiner*—J. Karl Bell
*Attorney, Agent, or Firm*—Philip D. Amins

[57] ABSTRACT

The present invention provides a stone structural securement system and method. In particular, an intermediate sheet steel strut member having a predetermined structural and geometrical configuration is interconnected between the structural frame of an edifice and the exterior masonry panels thereof which serve as facings. The strut members are secured to the structural frame by means of specialized clip members and the facing panels are secured to the strut members by stone anchor and clip arrangements.

54 Claims, 25 Drawing Figures

FIG. 3
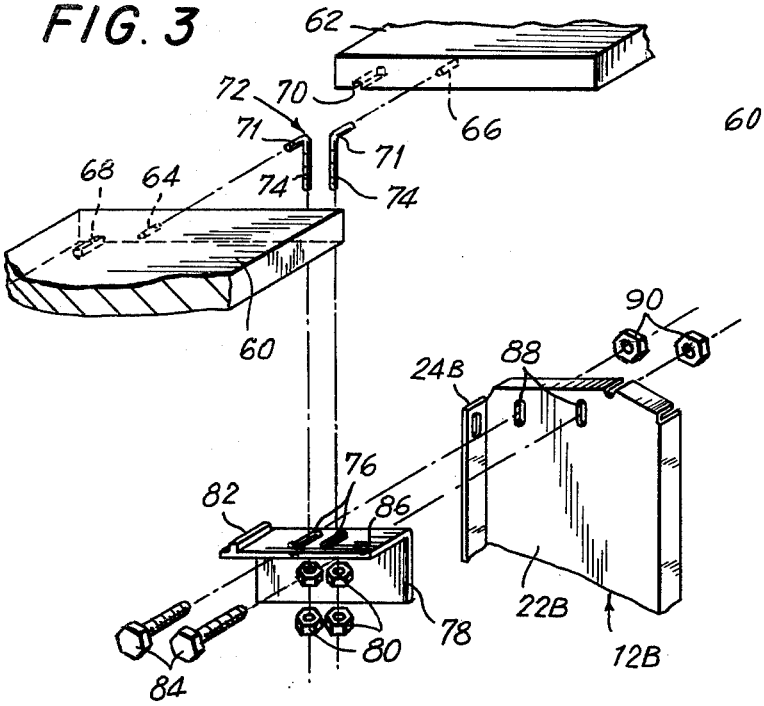
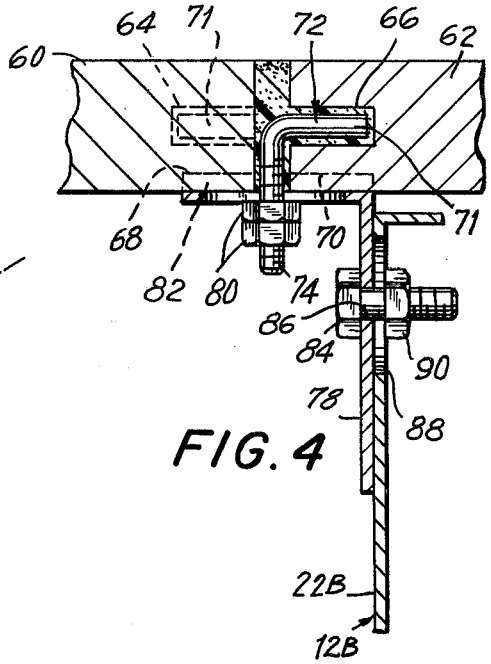
FIG. 4
FIG. 5
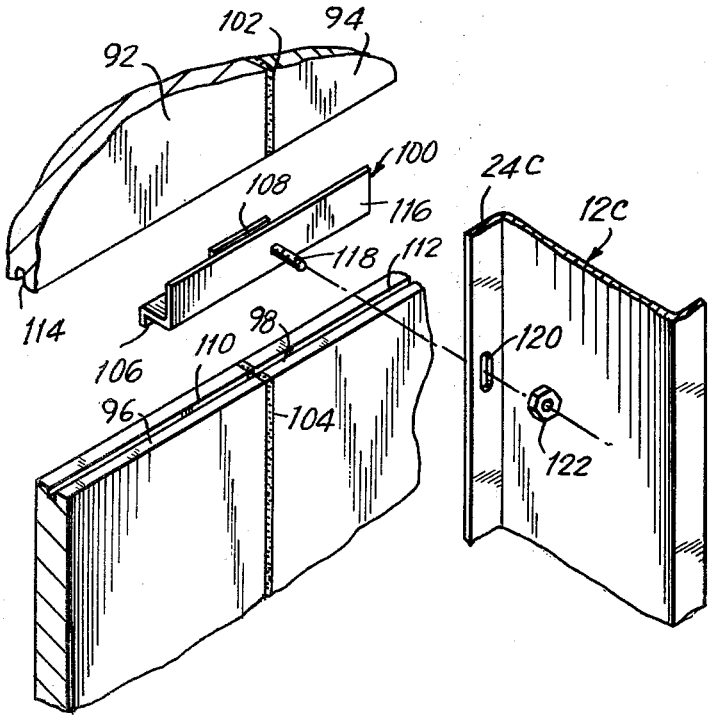
FIG. 6
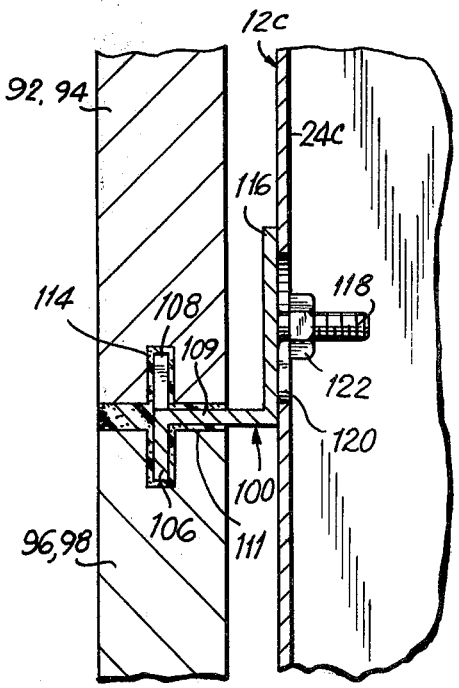

FIG. 7
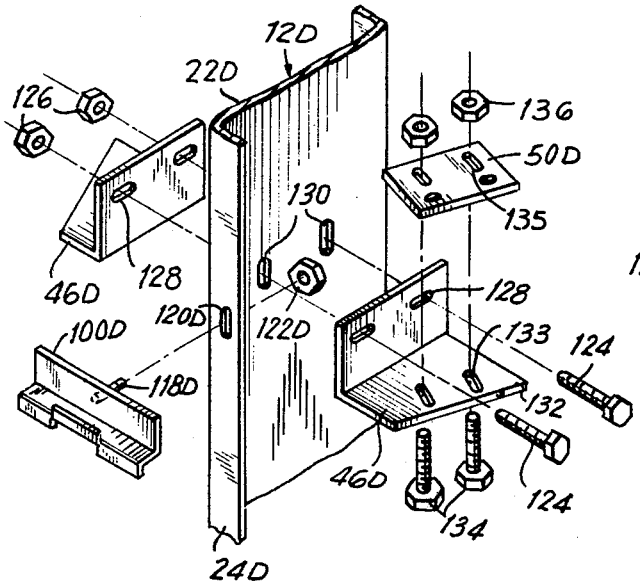
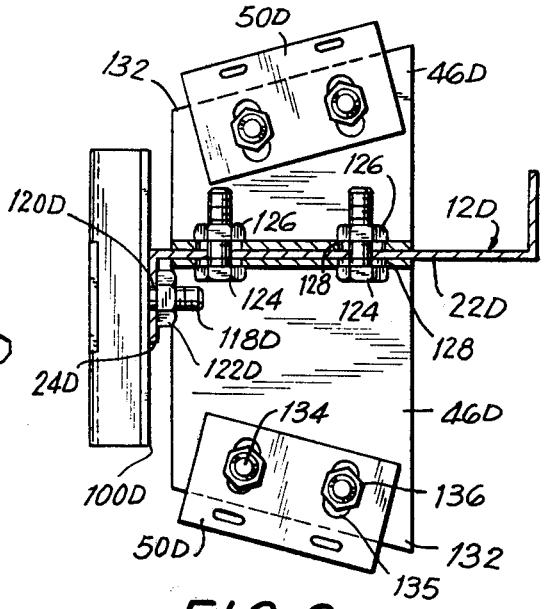
FIG. 8
FIG. 9
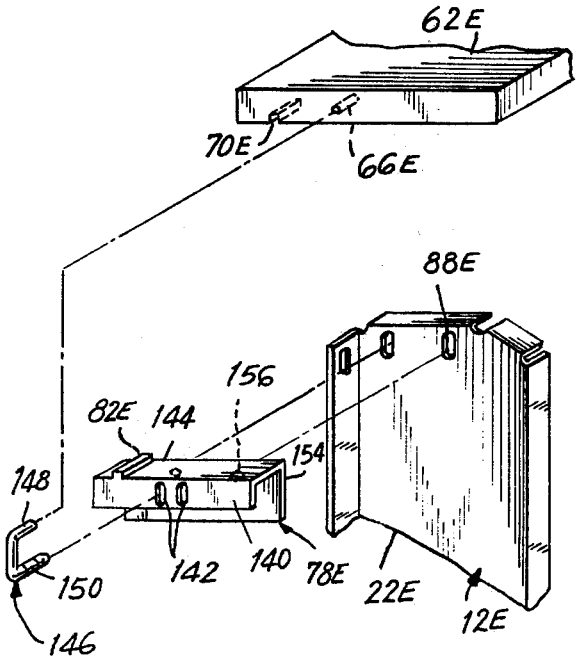
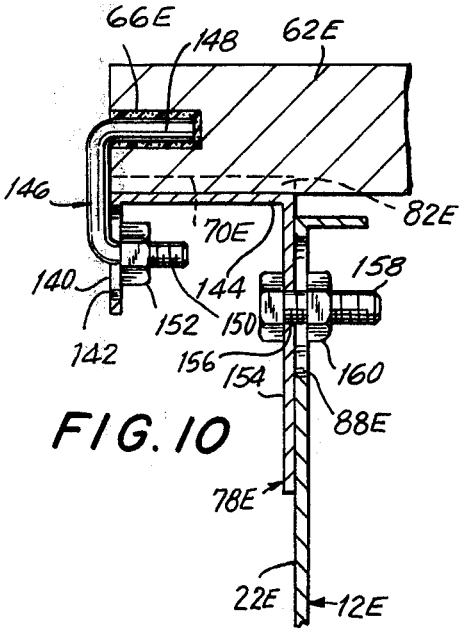
FIG. 10

FIG. 11
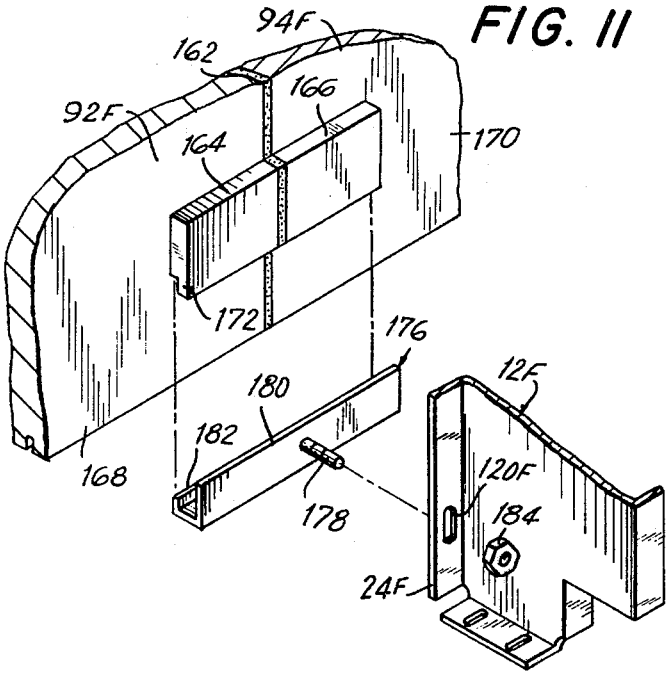
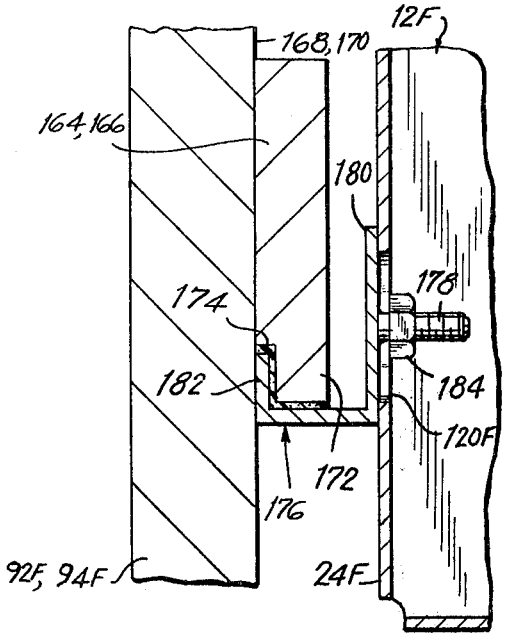
FIG. 12
FIG. 13
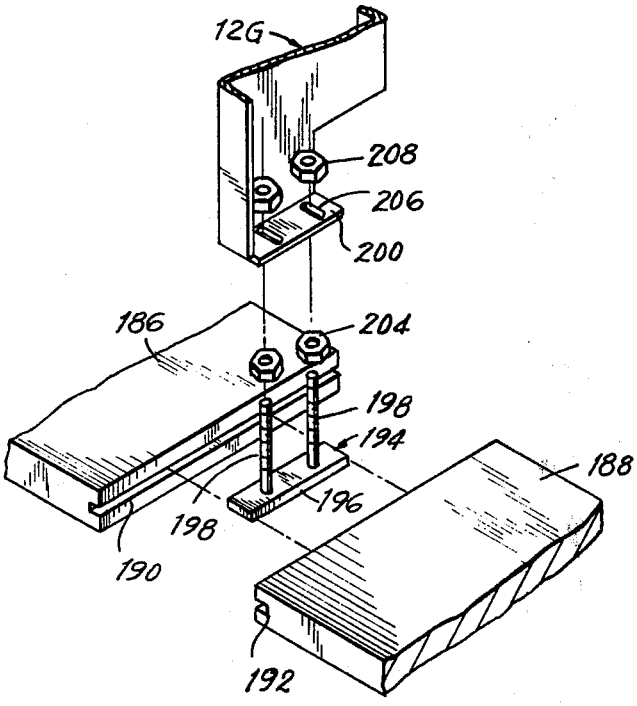
FIG. 14
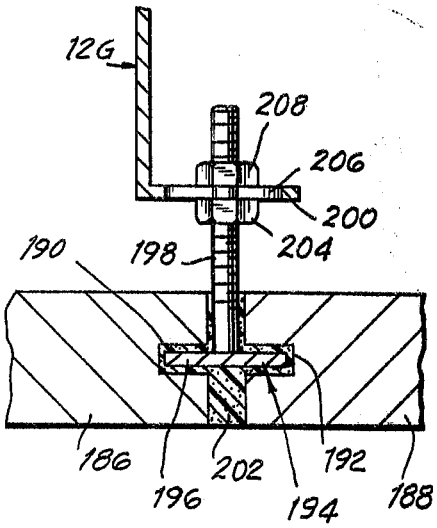

FIG. 15
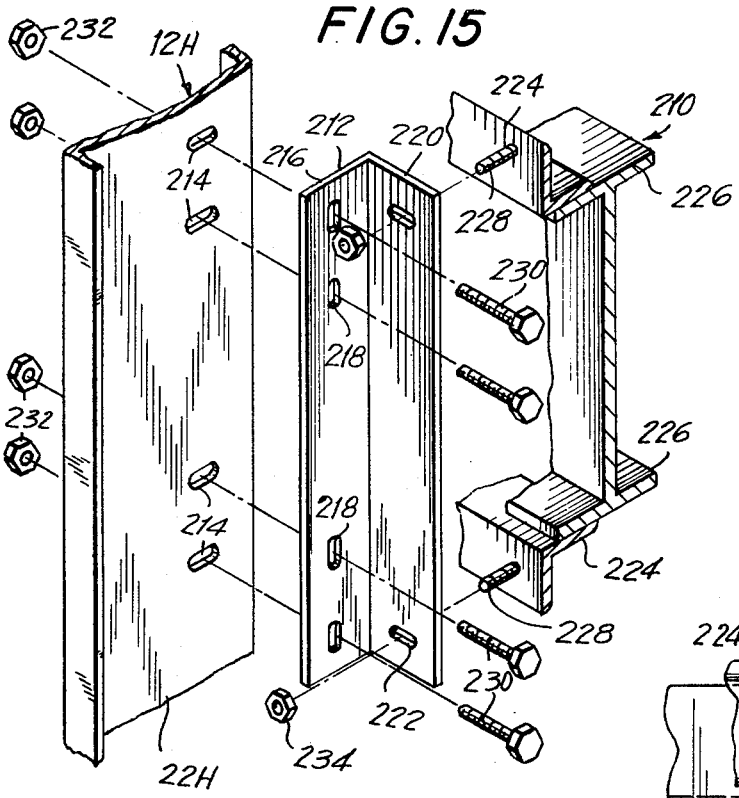
FIG. 16
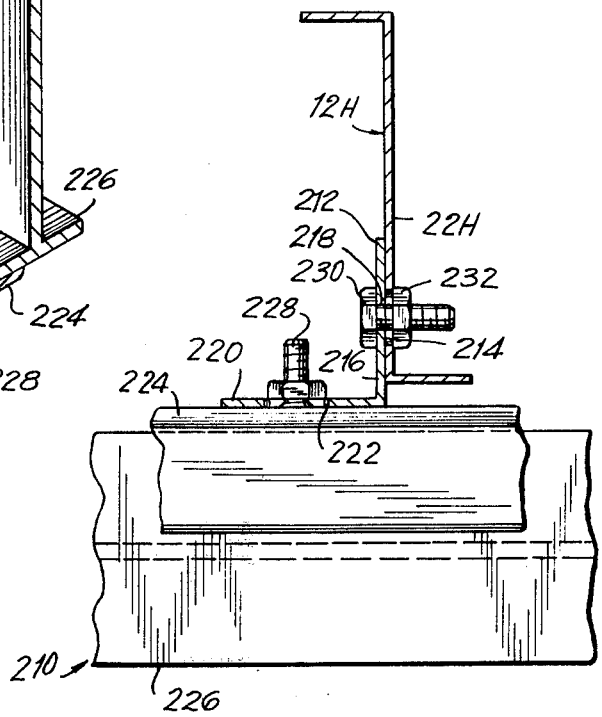
FIG. 17
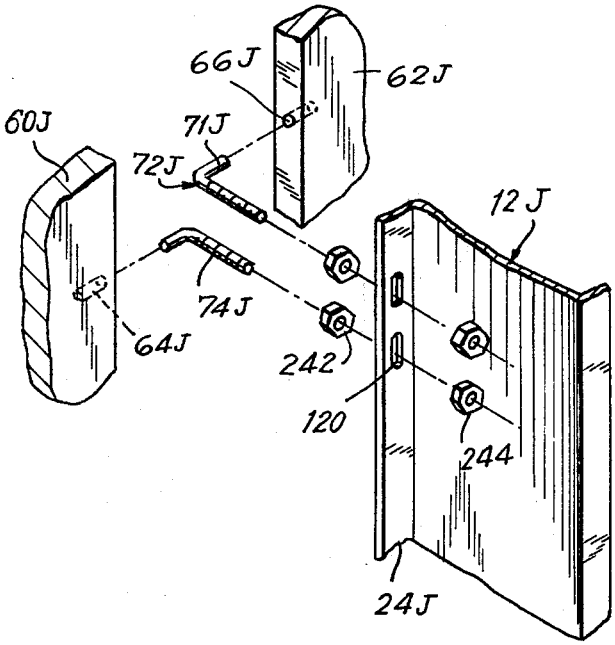
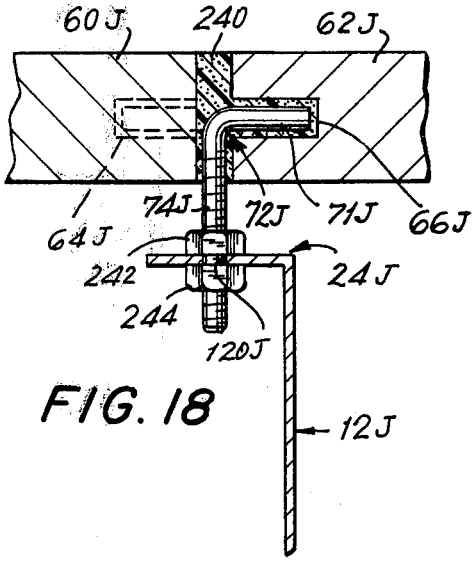
FIG. 18

STONE STRUCTURAL SECUREMENT SYSTEM AND METHOD

BACKGROUND OF THE INVENTION

Heretofore support frames for securing exterior panel facings to the structural frame of a building or other edifice were cumbersome and difficult to construct. Moreover, the frames were of massive construction requiring a great deal of welding and were, of course, very expensive and time consuming to construct. The support frames were fabricated from angle irons and standard structural members. Once fabricated, they were thereafter welded to the structural frame. It will, therefore, be apparent that the cost of erecting facings was very substantial, rendering the use of this type of construction very expensive.

SUMMARY OF THE INVENTION

The present invention provides a new and novel system and method of fabricating preformed intermediate structural strut members for connecting, by usual securement means, the exterior masonry facings to the structural frame of an edifice. The system provides equal or greater structural rigidity at a lesser cost and at a lesser weight for the structural members.

Accordingly, it is the primary object of the present invention to provide a new and novel system and method for securing the exterior panel facings of an edifice to the structural frame thereof.

It is another object of the present invention to provide a system as aforesaid utilizing preformed structural strut members for interconnecting the masonry panel facings and the structural frame.

It is still another object of the present invention to provide preformed structural strut members having predetermined geometrical configurations which are capable of connection to the masonry panel facings by stone anchors and clips.

It is yet another object of the present invention to provide structural strut members of the aforementioned type which are capable of easy and secure connection to the structural frame of an edifice by standard clip and nut and bolt arrangements.

It is still another object of the present invention to provide structural strut members of the aforementioned type which act as skeletal members and which have provision for the direct securement of building components thereto.

BRIEF DESCRIPTION OF THE DRAWINGS

The foregoing and other objects, features and advantages of the present invention will become more apparent from the detailed description hereinafter considered in conjunction with the accompanying drawings, wherein:

FIG. 3 is a partial perspective view of a stone anchor and clip arrangement for securing two adjacently disposed exterior masonry panels to an intermediate sheet steel strut member;

FIG. 4 is an assembled cross-sectional view of the configuration shown in FIG. 3;

FIG. 5 depicts another embodiment for securing the adjacently disposed masonry panels to an intermediate strut member and employing a specialized stone anchor member;

FIG. 6 is a sectional view of the assembled configuration of FIG. 5;

FIG. 7 depicts another embodiment for securing the exterior masonry panels to an intermediate strut member employing the special stone anchor member depicted in FIG. 5;

FIG. 8 is a sectional view of the assembly configuration of FIG. 7;

FIG. 9 is a perspective view depicting the securement of an exterior masonry wall to the body portion of an intermediate strut member employing standard stone anchor and clip members;

FIG. 10 is a sectional view of the assembled structure of FIG. 9;

FIG. 11 depicts another embodiment of the securement of two adjacently positioned masonry panels to the intermediate strut member by the utilization of a standard stone anchor member;

FIG. 12 is a cross-sectional view of the assembled structure of FIG. 11;

FIG. 13 depicts another embodiment wherein two adjacently disposed masonry soffit panels are secured to an intermediate strut member utilizing a standard stone anchor structure;

FIG. 14 is a sectional view of the assembled structure of FIG. 13;

FIG. 15 is a perspective view depicting the securement of an intermediate sheet steel strut member to the steel structural frame of an edifice;

FIG. 16 is a cross-sectional view of the assembled structure of FIG. 15;

FIG. 17 is a perspective view depicting the securement of two adjacently disposed masonry panels to an intermediate strut member by the utilization of standard anchor bolts;

FIG. 18 is a cross-sectional view depicting the assembled configuration of FIG. 17;

DETAILED DESCRIPTION OF THE PREFERRED EMBODIMENTS

Figure 1:
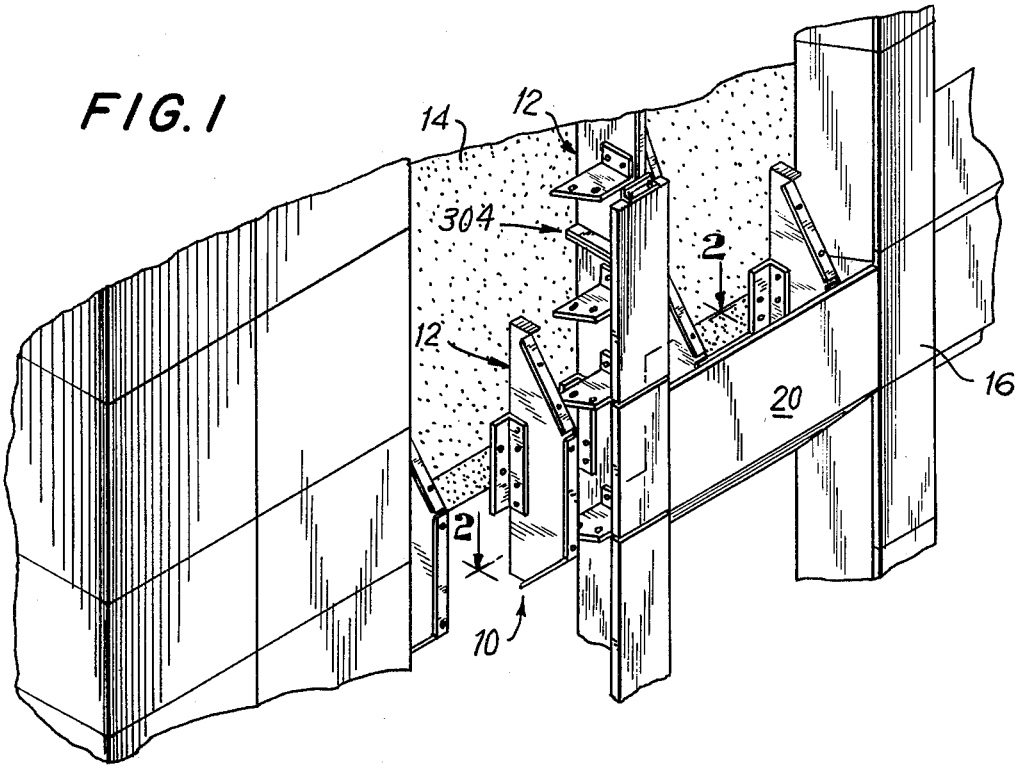
FIG. 1 is a perspective view of the exterior of a building utilizing the panel structural securement system of the present invention.
Figure 2:
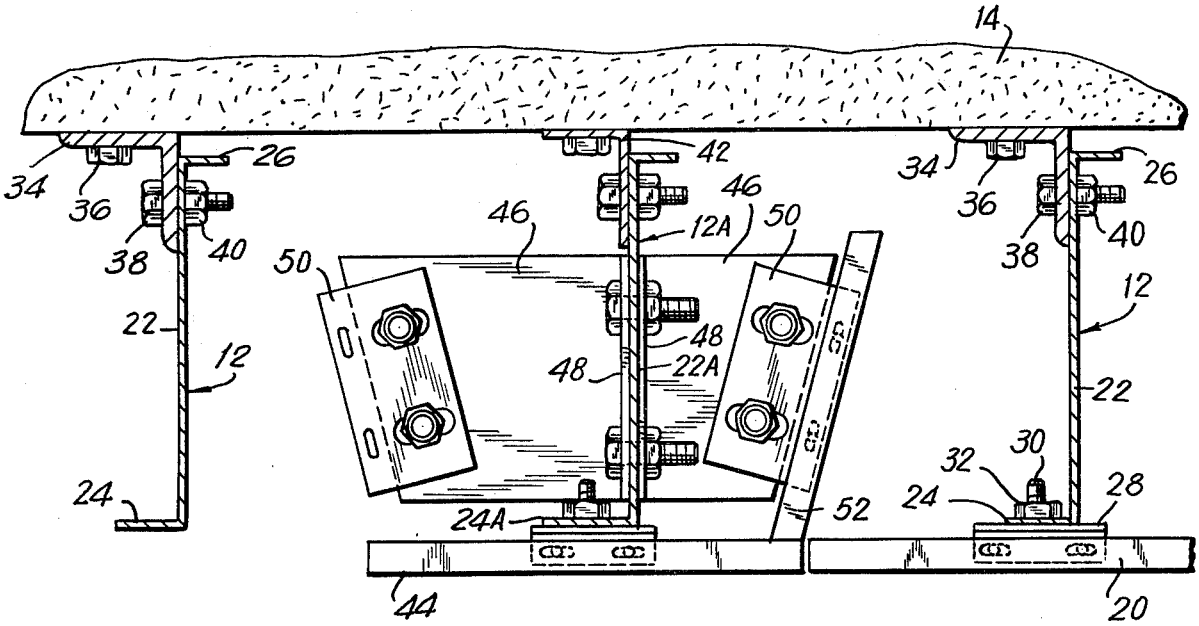
FIG. 2 is a sectional view taken on the line 2—2 of FIG. 1.

With reference now to FIGS. 1 and 2 of the drawings, there is depicted the new and novel stone structural securement system and method of the present invention. More particularly, there is illustrated a strut support system, generally denoted by the reference numeral 10 wherein a plurality of predeterminedly formed intermediate structural steel struts 12 are interconnected between the structural frame 14 and the outer masonry panel facing 16 of a building. The intermediate strut members 12 are preferably formed of sheet steel so that they serve to reinforce the structural rigidity of the masonry panels while concomitantly serving to connect the same with respect to the structural frame 14 of the building, which in the present embodiment is depicted as a roughly finished concrete structure. The term masonry as applied to the masonry panels herein is intended to include stone, composition, steel, plastic and other similar panel materials. However, in the present invention, specific reference shall be had only to stone panels for the sake of simplicity and ease of description.

With reference to FIG. 2, it will be seen that a first stone panel 20 is secured to the structural frame 14 by a particular one of the intermediate strut members 12. The intermediate strut 12 comprises a planar body portion 22, a front flange portion 24 and a rear flange portion 26. A stone anchor 28 having a protruding threaded bolt 30 secures the masonry panel 20 with respect to the flange 24. This is accomplished by having the threaded bolt 30 extend through the elongated slot (not shown) in the flange portion 24, whereafter the same is securely positioned by means of a nut 32. The body portion 22 is secured to the structural frame 14 by an angle iron 34 secured to the frame 14 by a bolt 36. In similar fashion, a bolt and nut, 38 and 40, respectively secure the angle iron to the body portion 22.

Another intermediate strut member 12A is secured to the frame 14 by an angle clip 42 and associated nut and bolt assemblies. Another masonry panel 44 is secured to the flange 24A in a manner similar to that discussed hereinabove. Secured to the body portion 22A of the strut member 12A are a plurality of lateral clip members 46 whose upright flanges 48 are secured to the body portion 22A by standard nut and bolt assemblies. Thereafter, additional clips 50 may be secured to the clip members by standard nut and bolt assemblies. The right hand clip members, as seen in FIG. 2, are then secured to a side stone panel 52 which serves as the window jamb, in the building. It will thus be apparent to those skilled in the art that the intermediate steel struts not only serve to interconnect the stone wall facings to the structural frame of the building but also permit additional connection to the body portion thereof by clip members and clip assemblies, which may, in turn, have other building components such as windows, insulation, sills and the like secured thereto.

Referring now to FIGS. 3 and 4, there are depicted two adjacently disposed stone panels 60 and 62 which serve as window sills. The panels 60 and 62 are provided with lateral bores 64 and 66, respectively, and lateral slots or notches 68 and 70, respectively. Right angle anchors 72 have the lateral end portions 71 thereof inserted in the bores 64 and 66 and the threaded end bolt portions 74 thereof extend through elongated slots 76 formed in a clip member 78 and are secured to the clip member by means of nuts 80. The clip is also formed with a boss 82 which is adapted to be inserted into the slots 68 and 70 for positional securement of the panels 60 and 62. The clip member is then connected to an intermediate strut member 12B by bolts 84 passing through holes 86 formed in the clip member and elongated slots 88 formed in the body portion 22B of the strut member 12B. The bolts 84 are secured by means of nuts 90. It is to be noted that the intermediate strut member 12B is connected to the structural frame of the building and that other stone panels are secured to the flange 24B in the manner described hereinbefore in conjunction with FIGS. 1 and 2.

With reference to FIGS. 5 and 6, there are depicted portions of two panels 92 and 94 which are to be secured with respect to panels 96 and 98 and which joint panel assembly is to be thereafter secured with respect to an intermediate strut member 12C by means of a specialized anchor member 100. The edges of the panels 92 and 94 have a joint 102 formed therebetween while the edges of the panels 96 and 98 have a joint 104 therebetween. The stone anchor has a substantially Z-shaped configuration with the outer edges thereof being bent downwardly, as at 106, and with the central portion thereof being bent upwardly, as at 108. The edges 106 are adapted to engage the recesses 110 and 112 formed in the upper edges of the panels 96 and 98, respectively, while the edge 108 is adapted to be seated in the slots or grooves 114 of the panels 92 and 94. The upstanding or vertical rear portion 116 of the anchor is provided with an integrally formed threaded bolt 118 which extends through an elongated slot 120 formed in the flange 24C of the strut member. The anchor 100 is then securely connected to the flange 24C and thus, the intermediate strut member 12C by means of a nut 122. The central body portion 109 of the anchor member 100 is positionally disposed in the horizontal joint 111 formed between the pairs of panels 92, 94 and 96, 98 as best seen in FIG. 6.

With reference to FIGS. 7 and 8, there is depicted the stone anchor 100D secured to the flange 24D of an intermediate strut member 12D. The anchor 100D is secured to the flange 24D by means of threaded bolt 118D extending through an elongated slot 120D and secured by a nut 122D. Lateral clip members 46D are secured to the body portion 22D by means of bolts and nuts 124 and 126, respectively. The bolts extend through the elongated horizontally disposed slots 128 in the clip members 46D and through the vertically disposed elongated slots 130 formed in the body portion 22D. It will be readily apparent to those skilled in the art that the elongated slots 128 and 130 provide for sufficient adjustable connection of the clip members 46D with respect to the body portion 22D of the intermediate strut member 12D. Thereafter, another clip or stone anchor 50D can be secured to the laterally extending portion 132 of clip member 46D by means of bolts 134 and nuts 136, passing through the aligned elongated slots 133 and 135 of the clip member 46D and member 50D, respectively.

With reference now to FIGS. 9 and 10, there is shown another embodiment of the present invention for securing a stone panel 62E with respect to a clip member 78E and the intermediate strut member 12E. In this embodiment, the stone panel 62E is provided with a lateral bore 66E and a lateral notch 70E. The clip member 78E is of substantially U-shaped construction having a front flange or leg 140 and a pair of vertically oriented elongated slots 142 disposed therewithin. The base portion 144 of the U-shaped clip member 78E is provided with a boss 82E. A U-shaped stone anchor 146 has the leg 148 thereof disposed within the bore 66E and the other leg 150 thereof, which is threaded, extends through one of the elongated slots 142 and is secured with respect to the flange 140 by means of a nut 152. It will be noted that the boss 82E is then disposed within the lateral notch 70E.

The other leg 154 of the clip member 78E is provided with a bore 156 and a threaded bolt 158 extends therethrough and through the vertically disposed elongated slot 88E in the body portion 22E of the intermediate strut member 12E. Thus, the clip member 78E is secured to the strut member 12E by means of the bolt 158 and a nut 160, as best seen in FIG. 10.

In FIGS. 11 and 12, there is depicted another embodiment of the present invention wherein two stone panels 92F and 94F are disposed in adjacent relationship having a joint 162 formed therebetween. Stone liners 164 and 166 are cemented to the rear surfaces 168 and 170 of the panels 92F and 94F, respectively. The liners are provided with a rear lip 172 which is spaced from the rear surfaces 168 and 170, so as to form a recess 174. A U-shaped stone anchor member 176 has an integrally formed threaded bolt 178 projecting outwardly from the leg 180 of the anchor member. The stone anchor member 176 also includes a shorter leg 182. The panels 92F and 94F are connected to the intermediate strut member 12F by positionally disposing the leg 182 within the recess 174. The threaded bolt 178 then passes through the elongated slot 120F of the front flange 24F of the intermediate strut member 12F and is secured in place by a nut 184.

In FIGS. 13 and 14, there is depicted another embodiment of the invention, wherein stone panels 186 and 188 are to be secured with respect to one another and to the intermediate strut member 12G so as to provide a window soffit arrangement. The panels 186 and 188 are provided with lateral grooves 190 and 192, respectively, extending along the side edges thereof. A specialized stone anchor 194 comprising a plate 196 having a pair of threaded bolts 198 extending upwardly therefrom is used to secure the panels 186 and 188 to the intermediate strut member 12G and, more particularly, to the bottom flange 200 of said strut member. The plate 196 is seated within the aligned grooves 190 and 192, as best seen in FIG. 14. A joint 202 is formed between the edges of the panels 186 and 188. The bolts 198 have nuts 204 secured thereon and the upper end of the bolts extend through elongated slots 206 formed in the flange 200. The upper ends of the bolts are then secured by nuts 208 so as to complete the securement of the connected panels 186 and 188 to the flange 200 and thus, to the intermediate strut member 12G. It is herein to be noted that the use of the nuts 204 and 208 provide vertical adjustment of the securement of the panels to the intermediate strut member.

Referring now to FIGS. 15 and 16, there is depicted an intermediate strut member 12H which is secured to the steel I-beam 210 which forms a part of the building frame 14, which was heretofore discussed.

An angle clip 212 is utilized to secure the strut member 12H with respect to the I-beam 210 in the following manner. The body portion 22H of the strut member is provided with a plurality of elongated horizontally disposed slots 214, while the leg 216 of the clip 212 is provided with a plurality of vertically disposed elongated slots 218. In a similar manner, the other leg 220 of the angle clip is provided with a pair of horizontally disposed elongated slots 222 disposed at the upper and lower edge portions of said leg. The steel I-beam has longitudinally extending support rails 224 welded or otherwise secured to the crossbar portions 226 of the I-beam. One leg of each of the support rails is provided with an outwardly extended threaded bolt 228. The angle clip is secured to the body portion 22H by bolts 230 which extend through the aligned slots 214 and 218; the bolts 230 being positionally secured by means of nuts 232. With the angle clip 212 and more particularly, the leg 216 being secured to the body portion 22H, the other leg 220 is then secured to the I-beam 210 by permitting the bolts 228 to pass through the slots 222 and secured by the nuts 234. Attention is directed to the fact that horizontal and vertical adjustment for the securement of the angle clip 212 to the strut member 12H is provided by the abutting alignment of the slots 214 and 218. Similarly, horizontal alignment for the securement of the angle clip 212 to the I-beam is provided by the elongated slots 222.

In FIGS. 17 and 18, there is depicted another embodiment of the present invention wherein two panels 60J and 62J are directly secured to the front flange portion 22J of an intermediate strut member 12J. The panels 60J and 62J are provided with lateral bores 64J and 66J formed in the side edges thereof. The right angle anchor 72J has the lateral end 71J thereof inserted within the bores 64J and 66J; a joint 240 is formed between the panels 60J and 62J, as best seen in FIG. 18. The threaded end bolt portions 74J of the right angle anchors have nuts 242 threaded thereon. The threaded bolt portions 74J then extend through vertical elongated slots 120J in the front flange portion 24J and are positionally secured by means of nuts 244, to thereby secure the connected panels 60J and 62J to the intermediate strut member 12J.

Figure 19:
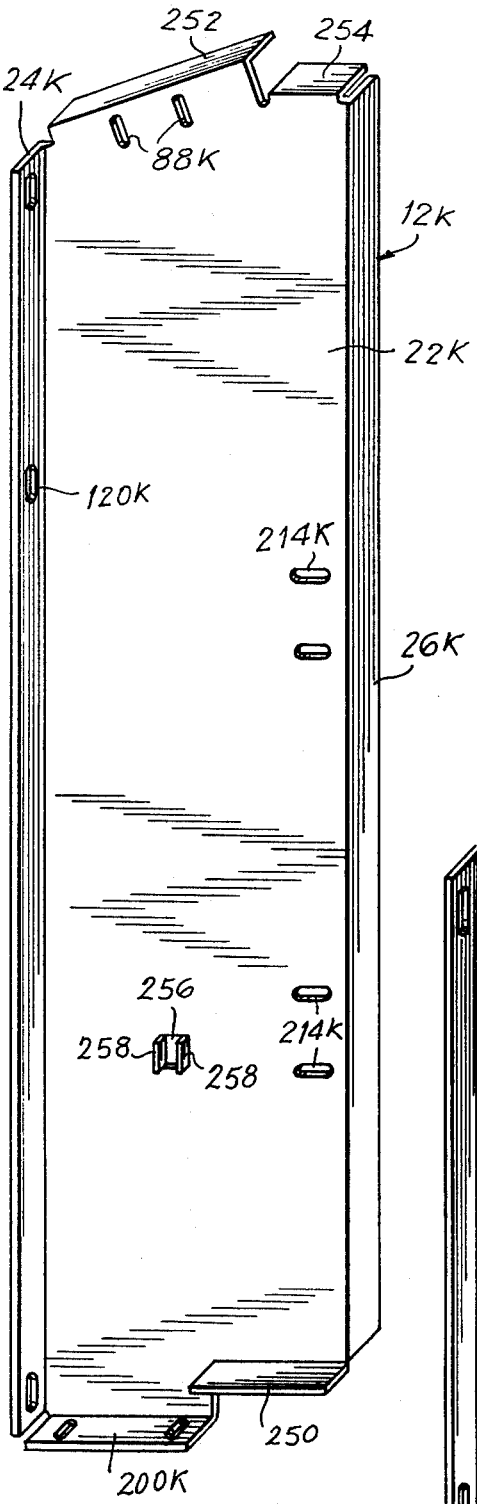
FIGS. 19 through 23 depict a plurality of the predetermined structural and geometrical configurations of the intermediate steel strut members of the present invention.

In. FIG. 19, there is shown another of the intermediate strut members, formed in accordance with the principles of the present invention and denoted generally by the reference numeral 12K. The strut 12K is provided with a body portion 22K and a front flange 24K for securement to stone anchors and to stone panels in the manner and pursuant to the embodiments described hereinbefore. In this regard, although we have depicted the strut 12K, as provided with vertical elongated slots 120K, the same may also be provided with horizontally disposed elongated slots. The bottom flange 200K serves as either a securement member or as a stiffening member and may be used in the attachment of stone panels or building components thereto as was described previously hereinbefore. The bottom portion of the strut 12K is also provided with a stiffener tab 250 disposed at a raised elevation with respect to the flange 200K. The strut 12K is also provided with a rear flange 26K which serves as a stiffening or securement member. The upper edge portion is provided with stiffener or securement tabs 252 and 254. The tab 252 may be used to support stone panels which form window sills, while the tab 254 may serve as a securement tab by having a clip or other component secured thereto by means of sheet metal screws or other fasteners (not shown). The body portion 22K is provided with a plurality of elongated slots 88K and 214K for purposes of utilization as described previously in conjunction with the earlier embodiments of the present invention. The body portion is also formed with an aperture 256 having side tabs 258 extending therefrom and forming said aperture. The aperture 256 permits passage of structural or mechanical components through the intermediate strut members, while the tabs 258 may be used for attaching or positioning of components passing through the aperture. Attention is directed to the fact that the tab 250 may be used for location and securement of other building components, such as windows, drapery pockets, insulation and the like, with respect to the strut 12K.

Figure 20:
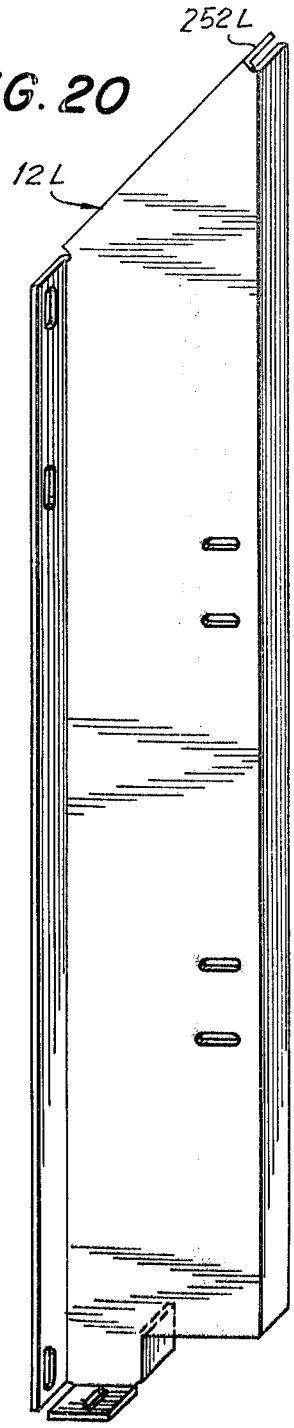

In FIG. 20, there is depicted a similar intermediate strut member 12L of similar construction to the strut member 12K except that the upper tab or flange portion 252L thereof is disposed in substantially a 45° angle and may have a stone panel secured directly thereto for use as a window sill.

Figure 21:
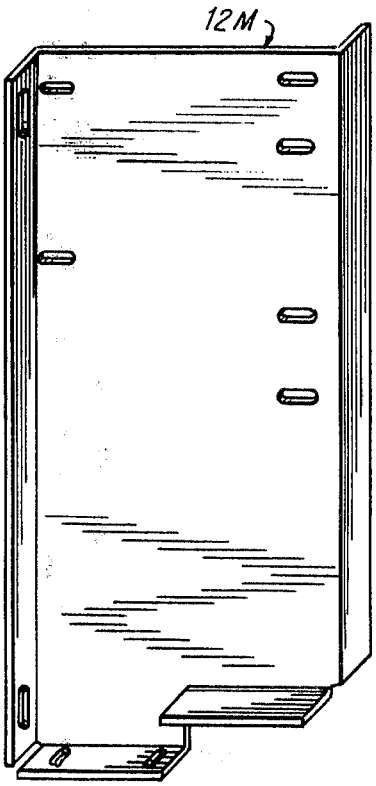

In FIG. 21, there is shown a shortened intermediate strut member 12M which is not provided with any upper tabs, flanges or securement member, but whose configuration is otherwise similar to the strut 12K shown in FIG. 19.

Figure 22:
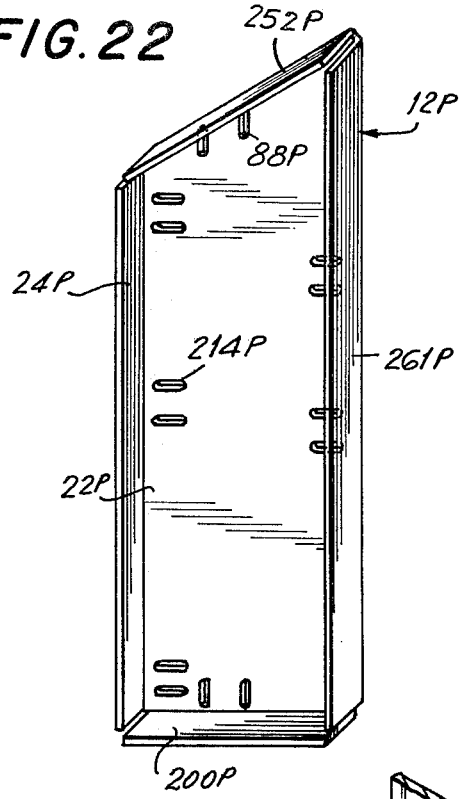

FIG. 22 depicts an intermediate strut member 12P having a substantially box-like configuration. The strut 12P is formed with the front flange 24P, the rear flange 26P, the bottom flange 200P and the upper flange 254P of solid configuration; i.e., having no slots formed therein, whereby these flanges serve as stiffening members but may be used as securement members by having sheet metal screws secured thereto. The body portion 22P is provided with a plurality of elongated slots 88P and 214P which are primarily intended for securement to stone panels or the building frame, as envisioned and described previously.

Figure 23:
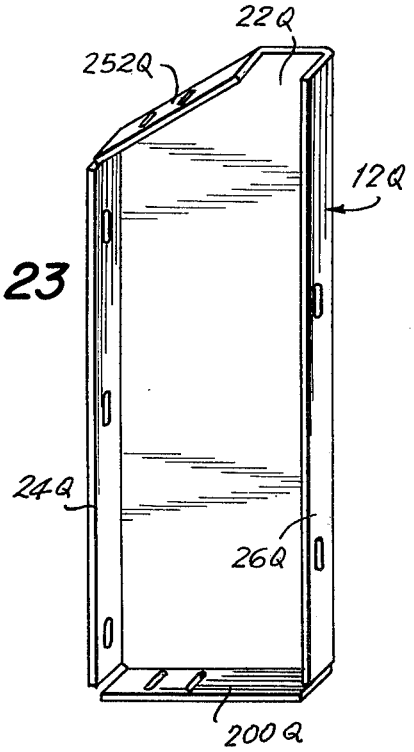

An alternate configuration of the intermediate strut, shown in FIG. 22, is depicted in FIG. 23, wherein the strut 12Q is formed with a body portion 22Q of solid configuration, having no elongated slots formed therein. However, the flanges 24Q, 26Q, 200Q and 252Q are each provided with securement-type elongated slots.

Figure 24:
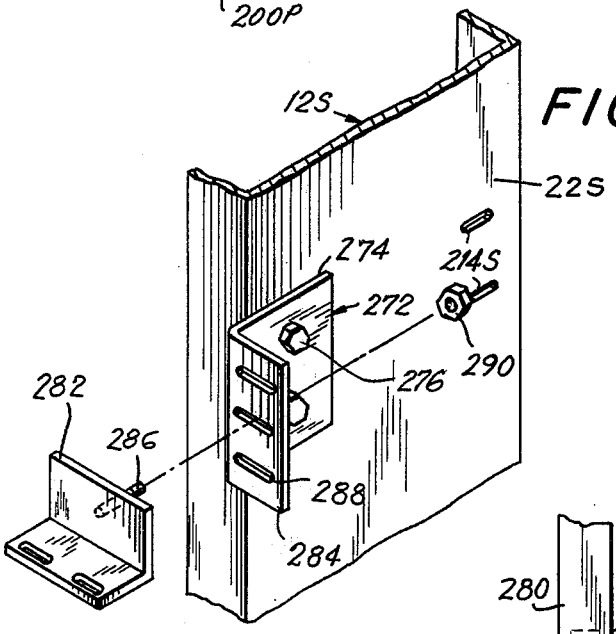
FIG. 24 is a partial perspective view depicting the method of adjustably securing a stone anchor to an intermediate strut member by the utilization of an adjustable clip secured to the intermediate strut member.
Figure 25:
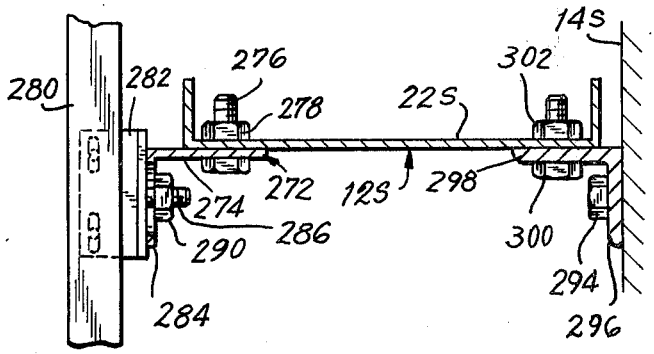
FIG. 25 is a cross-sectional view depicting the assembled construction of FIG. 24 secured to the structural frame of an edifice.

With reference now to FIGS. 24 and 25, there is depicted the last embodiment of the present invention. The intermediate strut member 12S includes a body portion 22S, having a plurality of slots 214S formed therein. An angle clip 272 has one leg 274 thereof secured to the body portion 22S by bolts 276 and nuts 278, as best seen in FIG. 25. A stone panel 280 is secured by means of a right angle anchor 282 to the leg 284 of the clip 272, in the following manner. An integrally formed threaded bolt 286, of the anchor, extends through one of three elongated slots 288 formed in the leg 284 of the clip and is positionally secured with respect thereto by a nut 290. The right side of the strut member, as viewed in FIGS. 24 and 25, is secured to the frame 14S of the building. The frame 14S in this embodiment is depicted as a concrete member but may also be a steel member such as an I-beam, as discussed hereinbefore. An angle iron 292 is used to reinforcingly secure the right side of the intermediate strut member to the building frame 14S by having a bolt 294 secure the leg 296 of the angle iron to the building frame. The other leg 298 of the angle iron is secured to the right side of the intermediate strut member 12S by means of a threaded bolt 300 and a nut 302.

It will be apparent to those skilled in the art that several of the various type intermediate strut members disclosed herein can be connected together for increased structural rigidity and facilitation of connection with respect to the stone panels and the structural frame of a building. In this regard, attention is directed to FIG. 1 of the drawings, wherein the lower flange 200 of one of the intermediate strut members can be secured or disposed in abutting engagement with another strut member and as indicated by the arrow 304. In a similar manner, the intermediate strut members may be secured in a horizontal fashion either by securement of the body portions 22 to one another or by means of clip members of other building components interconnected between adjacent ones of the body portions 22.

It is thus seen that I have described a plurality of embodiments for the utilization of the intermediate strut securement member of the present invention for securing outer stone panel facings with respect to the building frame of an edifice and which strut members provide for increased rigidity, lesser weight, the accommodation of other building components which might normally pass through the space between a stone panel facing and a building frame, and the securement of other building components directly thereto. Therefore, although I have described and envisioned many embodiments of the present invention, it will be apparent to those skilled in the art, that there are a number of modifications, changes and improvements which may be made herein without departing from the spirit and scope of the invention, as envisioned and described and as subsequently claimed herein.

What is claimed is:

1. A strut member for use in the interconnection of a structural frame and masonry panels of an edifice and comprising a substantially planar body portion of predetermined geometrical configuration, a plurality of flange members formed integrally with said body portion and disposed at predetermined edges of said body portion and at predetermined angular orientation with respect thereto, at least one of said flange members having apertures formed therein for enabling adjustable positional securement of said flange member to one of said masonry panels and said structural frame, and said body portion having apertures formed therein for enabling adjustable positional securement of said body portion to the other one of said masonry panels and said structural frame, thereby providing for secured interconnection of said strut member between said masonry panels and said structural frame.

2. A strut member in accordance with claim 1, wherein said apertures are of preselected geometric configuration and are disposed in predetermined orientation.

3. A strut member in accordance with claim 2, wherein said apertures have preselected geometric configurations disposed in predetermined orientation with respect to said one of said flange members.

4. A strut member in accordance with claim 2, wherein said apertures have preselected geometric configurations disposed in predetermined orientation with respect to said body portion.

5. A strut member in accordance with claim 2, wherein said apertures comprise elongated slots.

6. A strut member in accordance with claim 5, wherein said elongated slots are formed in predetermined orientation with respect to said one of said flange members and said body portion.

7. A strut member for use in the interconnection of a structural frame and masonry panels of an edifice and comprising a substantially planar body portion of predetermined geometrical configuration, a plurality of flange members formed integrally with said body portion and disposed at predetermined edges of said body portion and at pedetermined angular orientation with respect thereto, at least a selected one of said flange members and said body portion having means formed therein for enabling preselected securement of said flange member or said body portion to one of said masonry panels and said structural frame, means formed in another portion of said flange member or said body portion for enabling securement thereof to the other of said masonry panels and said structural frame, thereby providing for secured interconnection of said strut member between said masonry panels and said structural frame, said means for enabling selected securement of said flange member or said body portion comprises apertures of preselected geometric configuration and disposed in predetermined orientation which provide for adjustable positional securement with respect to said strut member, said body portion having front and rear flange members, said body portion also including selected top and bottom flange members, selected ones of said flange members being selectably securable to said masonry panels and said structural frame, and selected ones of said flange members comprising stiffening tab and building component securement members.

8. A strut member in accordance with claim 7, wherein selected ones of said top and bottom flange members are of composite construction having a plurality of tab members forming said last mentioned flange members.

9. A strut member in accordance with claim 8, wherein said tab members are disposed in spaced apart vertical relationship.

10. A strut member in accordance with claim 9, wherein said tab members forming one of said flange members are disposed in angular relationship with respect to one another.

11. A strut member in accordance with claim 7, wherein selected ones of said front, rear, top and side flange members and said planar body portion have elongated slots formed therein.

12. A strut member in accordance with claim 7, wherein said front and rear flange members extend from said body portion in the same direction.

13. A strut member in accordance with claim 7, wherein said front and rear flange members extend from said body portion in diametrically opposed directions.

14. A strut member in accordance with claim 7, wherein said front, rear, top and side members all extend from said body portion in the same direction.

15. A strut member in accordance with claim 7, wherein said body portion is provided with selected openings therein capable of having predetermined structural and building components extending through said body portion.

16. A strut member in accordance with claim 15, wherein said selected openings are formed by punching a portion of said body portion outwardly therefrom and providing peripheral tab elements about said selected openings.

17. In a structural system for securing masonry panels to the structural frame of an edifice the improvement comprising at least one strut member interposed between said masonry panels and said structural frame, said strut member comprising, a substantially planar body portion, and at least one flange member formed integrally with one edge of said body portion, first means for positionally securing at least two of said masonry panels to a predetermined first part of said strut member, and second means for positionally securing said structural frame to a predetermined second part of said strut member.

18. A structural system in accordance with claim 17, wherein both of said first and second means for positional securement include nut and bolt assemblies.

19. A structural system in accordance with claim 17, wherein the plane of said strut member is disposed in substantially orthogonal relationship to the plane of said masonry panels.

20. A structural system in accordance with claim 17, wherein said first part of said strut member comprises said flange member.

21. A structural system in accordance with claim 20, wherein said second part of said strut member comprises said body portion.

22. A structural system in accordance with claim 17, wherein said strut member comprises a plurality of flange members integrally connected to selected edges of said body portion, said first part of said strut member comprising a first one of said flange members, and said second part of said strut member comprising a second one of said flange members.

23. A structural system in accordance with claim 17, wherein said first means for positionally securing at least two of said masonry panels to said first part of said strut member includes a masonry anchor.

24. A structural system in accordance with claim 23, wherein said first means further includes a clip member, means for connecting said clip member to said anchor, and means for connecting said clip member to said first part of said strut member.

25. A structural system in accordance with claim 23, wherein said first means further includes a clip member, means for connecting said clip member to said anchor, and means for connecting said anchor to said first part of said strut member.

26. A structural system in accordance with claim 23, wherein said flange member is said first part of said strut member, and means for connecting said anchor to said flange member.

27. A structural system in accordance with claim 17, wherein said first positional securement means is capable of selective adjustable positioning.

28. A structural system in accordance with claim 17, wherein said second positional securement means is capable of selective adjustable positioning.

29. A structural system in accordance with claim 28, wherein said first positional securement means is capable of selective adjustable positioning.

30. In a structural system for securing masonry panels to the structural frame of an edifice the improvement comprising at least one strut member interposed between said masonry panels and said structural frame, said strut member comprising a substantially planar body portion, first means for positionally securing selected ones of said masonry panels to a predetermined first part of said strut member, second means for positionally securing said structural frame to a predetermined second part of said strut member, said strut member including a plurality of flange members, said flange members being connected to and formed integrally with selected ones of the front, rear, top and bottom edges of said body portion, selected ones of said flange members having elongated slots formed therein, said first means comprising a masonry anchor having a threaded anchor bolt portion, said first part of said strut member comprising a flange member, and said anchor bolt portion extending through said one of said elongated slots formed in said selected flange member and being securedly connected thereto by at least one nut engaging said threaded anchor bolt portion.

31. A structural system in accordance with claim 30, wherein predetermined ones of the other of said flange members comprises stiffening tab and building component securement members.

32. A structural system in accordance with claim 31, wherein said strut member includes top and bottom flange members, selected ones of said top and bottom flange members being of composite construction having a plurality of tab members forming said last mentioned flange members.

33. A structural system in accordance with claim 32, wherein said tab members are disposed in spaced apart vertical relationship.

34. A structural system in accordance with claim 33, wherein said tab members forming one of said flange members are disposed in angular relationship with respect to one another.

35. A structural system in accordance with claim 30, wherein said front and rear flange members extend from said body portion in the same direction.

36. A structural system in accordance with claim 30, wherein said front and rear flange members extend from said body portion in diametrically opposed directions.

37. A structural system in accordance with claim 30, wherein said front, rear, top and bottom flange members all extend from said body portion in the same direction.

38. A structural system in accordance with claim 30, wherein said body portion is provided with selected apertures therein capable of having predetermined structural and building components extending through said body portion.

39. A structural system in accordance with claim 38, wherein said selected apertures are formed by punching a portion of said body portion outwardly therefrom and providing peripheral tab elements about said selected apertures.

40. A structural system in accordance with claim 38, wherein said body portion is provided with predetermined elongated slots, and said slots being selectively capable of having said body portion secured to said structural frame and to selected other building component members.

41. A structural system in accordance with claim 40, including means for securing adjacent ones of said strut members with respect to one another.

42. A structural system in accordance with claim 41, wherein said last mentioned securement means extend through selected ones of said elongated slots formed in said body portion for securing together horizontally adjacent strut members.

43. A structural system in accordance with claim 41, wherein said last mentioned securement means extends through adjacently disposed flange members in adjacently disposed strut members for securing together said strut members in substantial vertical alignment.

44. A structural system in accordance with claim 30, wherein said masonry panel secured to said selected flange member serves as a window sill.

45. A structural system in accordance with claim 30, wherein said masonry panel secured to said selected flange member serves as a window soffit.

46. The method of securing masonry panels to the structural frame of an edifice comprising the steps of providing an intermediate strut member of contoured predetermined configuration having a substantially planar body portion and at least one flange member integrally connected to one edge of said body portion, disposing the strut member between the structural frame and masonry panels, connecting a first part of said strut member to said structural frame, connecting a second part of said strut member to said masonry panels, the step of connecting a masonry anchor to said second part of said strut member, and thereafter securing said masonry anchor to said masonry panels, the step of connecting a clip member to said structural frame, and thereafter securing said strut member body portion to said clip member.

47. The method of securing masonry panels to the structural frame of an edifice comprising the steps of providing an intermediate strut member of contoured predetermined configuration having a substantially planar body portion and at least one flange member integrally connected to one edge of said body portion, disposing the strut member between the structural frame and the masonry panels, connecting a first part of said strut member to said structural frame, connecting said flange member to said masonry panels, the step of connecting a clip member to said flange member, connecting a masonry anchor to said clip member, and then connecting said masonry anchor to said masonry panels.

48. The method of securing masonry panels to the structural frame of an edifice comprising the steps of providing an intermediate strut member of contoured predetermined configuration having a substantially planar body portion and at least one flange member integrally connected to one edge of said body portion, disposing the strut member between the structural frame and the masonry panels, connecting a first part of said strut member to said structural frame, connecting said flange member to said masonry panels, the step of forming predeterminedly positioned elongated slots in said flange member, securing an anchor having a threaded bolt portion to said flange member by positioning said threaded bolt portion through a selected one of said elongated slots and securing said bolt portion with respect to said flange member by threaded engagement of said bolt portion with at least one nut, and securing said masonry panels to said anchor.

49. The method of securing masonry panels to the structural frame of an edifice comprising the steps of providing an intermediate strut member of contoured predetermined configuration having a substantially planar body portion and at least one flange member integrally connected to one edge of said body portion, disposing the strut member between the structural frame and the masonry panels, connecting a first part of said strut member to said structural frame, connecting a second part of said strut member to said masonry panels, the step of providing an intermediate strut member having selected front, rear, top and bottom flange members, forming elongated slots in selected ones of said flange members and said body portion, selectively positioning said masonry panels to selected ones of said flange members and said body portion, and positionally securing said selected masonry panels to said selected flange members by nut and bolt assemblies.

50. The method of securing masonry panels to the structural frames of an edifice in accordance with claim 49, including the step of forming selected ones of said flange members as composite members having a plurality of tab members, and disposing said tab members in predetermined angular orientation.

51. The method of securing masonry panels to the structural frames of an edifice in accordance with claim 50, including the step of disposing said tab members in spaced apart vertical relationship.

52. The method of securing masonry panels to the structural frame of an edifice in accordance with claim 50, including the step of disposing said tab members in predetermined angular relationship with respect to one another.

53. The method of securing masonry panels to the structural frame of an edifice comprising the steps of providing an intermediate strut member of contoured predetermined configuration having a substantially planar body portion and at least one flange member integrally connected to one edge of said body portion, disposing the strut member between the structural frame and the masonry panels, connecting a first part of said strut member to said structural frame, connecting a second part of said strut member to said masonry panels, connecting said masonry panels to said second part of said strut member to form a subassembly, thereafter securing said subassembly to said structural frame by securement of said first part of said strut member to said structural frame, the step of forming predeterminedly positioned elongated slots in said flange member, securing an anchor having a threaded bolt portion to said flange member by positioning said threaded bolt portion through a selected one of said elongated slots and securing said bolt portion with respect to said flange member by threaded engagement of said bolt portion with at least one nut, and securing said masonry panels to said anchor.

54. The method of securing masonry panels to the structural frame of an edifice in accordance with claim 53, including the step of securing a clip member to said structural frame, and thereafter securing said subassembly to said clip member by securement of said first part of said strut member to said clip member.

* * * * *